United States Patent [19]

Herrmann, Jr.

[11] 3,995,930

[45] Dec. 7, 1976

[54] HIGH VOLTAGE TUBE CONNECTOR

[75] Inventor: Henry Otto Herrmann, Jr., Mt. Joy, Pa.

[73] Assignee: AMP Incorporated, Harrisburg, Pa.

[22] Filed: June 2, 1975

[21] Appl. No.: 583,303

[52] U.S. Cl. ..... 339/143 R; 174/89; 339/191 R; 339/217 S

[51] Int. Cl.[2] ..... H01R 13/36

[58] Field of Search ..... 339/103, 104, 111, 143, 339/177, 191, 192, 140, 142, 223; 174/75 C, 89

[56] References Cited

UNITED STATES PATENTS

| | | | |
|---|---|---|---|
| 2,728,060 | 12/1955 | Doeg | 339/192 RL |
| 3,264,602 | 8/1966 | Schwartz | 339/177 R |
| 3,399,374 | 8/1968 | Pauza et al. | 339/91 R |

FOREIGN PATENTS OR APPLICATIONS

| | | | |
|---|---|---|---|
| 1,157,274 | 5/1958 | France | 339/177 E |
| Ad.91687 | 6/1968 | France | 339/177 R |

*Primary Examiner*—W. Tupman
*Assistant Examiner*—Neil Abrams
*Attorney, Agent, or Firm*—Gerald K. Kita

[57] ABSTRACT

An all dielectric right angle connector is disclosed for interconnecting a pluggable high voltage tube with an electrical high voltage lead. A high voltage lead is terminated with an electrical receptacle type contact which is latchably retained within an elbow portion of the connector. A braided conductive sheath or shielding of the cable is received over an end of the connector provided with projecting teeth. A tapered sleeve is latchably secured to the teeth captivating the sheath. The sleeve is oriented by a polarizing feature of the connector. The contact is deeply recessed from each end of the connector for shock protection.

3 Claims, 4 Drawing Figures

HIGH VOLTAGE TUBE CONNECTOR

FIELD OF THE INVENTION

The present invention relates to a high voltage electrical connector and more particularly to an all dielectric connector for interconnecting a pluggable high voltage electrical tube with a high voltage electrical lead.

BACKGROUND OF THE PRIOR ART

High voltage electrical tubes have been devised to operate as electrostatic space charge devices and electroluminescent devices. Such tubes have particularly been useful in a document copy machine for photodeveloping and for producing electrostatic fields on copy paper for various purposes. Such tubes are activated by high voltage pulses supplied from a suitable power source through a high voltage electrical lead. A need has existed for a connector which suitably connects the high voltage leads to corresponding tubes offering shock protection and also removable but positive connections for the tubes to allow replacement thereof when needed. The connectors must also be separable from the electrical leads and also provide an inexpensive technique for anchoring or terminating the conductive braids or outer sheaths of high voltage leads.

BRIEF DESCRIPTION OF THE INVENTION

The present invention is in the form of an all dielectric right angle connector which pluggably receives a high voltage electrical tube at one end and which pluggably receives in the other end a high voltage electrical lead terminated to a receptacle type contact. The contact is latchably but removably received in the connector to anchor the same to the lead. The receptacle is adapted for removable and pluggable connection to a high voltage electrical tube. Deeply recessed within the elbow portion of the connector for shock protection the contact enables removal of the tube from the connector without dangerous exposure of the contact or electrical lead. The other end of the connector is tapered and provided with outwardly projecting teeth. The outer conductive sheath of the electrical lead is readily received over the tapered end and the teeth. A complimentary tapered sleeve is slidably received over the tapered end and is latchably secured to the teeth by complimentary apertures in the sleeve which receive the teeth. A polarizing feature is provided by an integral ridge on the connector which registers within a corresponding notch in the sleeve whereby proper orientation of the sleeve on the connector tapered end is achieved.

OBJECTS

Accordingly it is an object of the present invention to provide an all dielectric connector for removably interconnecting a pluggable high voltage electrical tube with a corresponding high voltage electrical lead.

Another object of the present invention is to provide a right angle high voltage connector which pluggably receives a high voltage electrical lead terminated with an electrical receptacle contact removably secured within the connector and substantially recessed within the connector for shock protection yet permitting pluggable connection thereto of a high voltage electrical tube.

Another object of the present invention is to provide an all dielectric connector for pluggably interconnecting a pluggable high voltage tube with an electrical high voltage lead having a conductive sheath thereover which is captivated on an end of the connector which is shaped for complimentary receipt of a sleeve thereover.

Another object of the present invention is to provide an all dielectric connector for interconnecting a pluggable high voltage tube and an electrical high voltage lead with one end of the connector being shaped for complimentary receipt of a sleeve thereover, the sleeve latching to projecting teeth of the connector and captivating a conductive sheath of the high voltage electrical lead.

Other objects and many advantages of the present invention are made apparent by the following detailed description taken in conjunction with the accompanying drawings.

DETAILED DESCRIPTION OF THE PREFERRED EMBODIMENT

Figure 1:
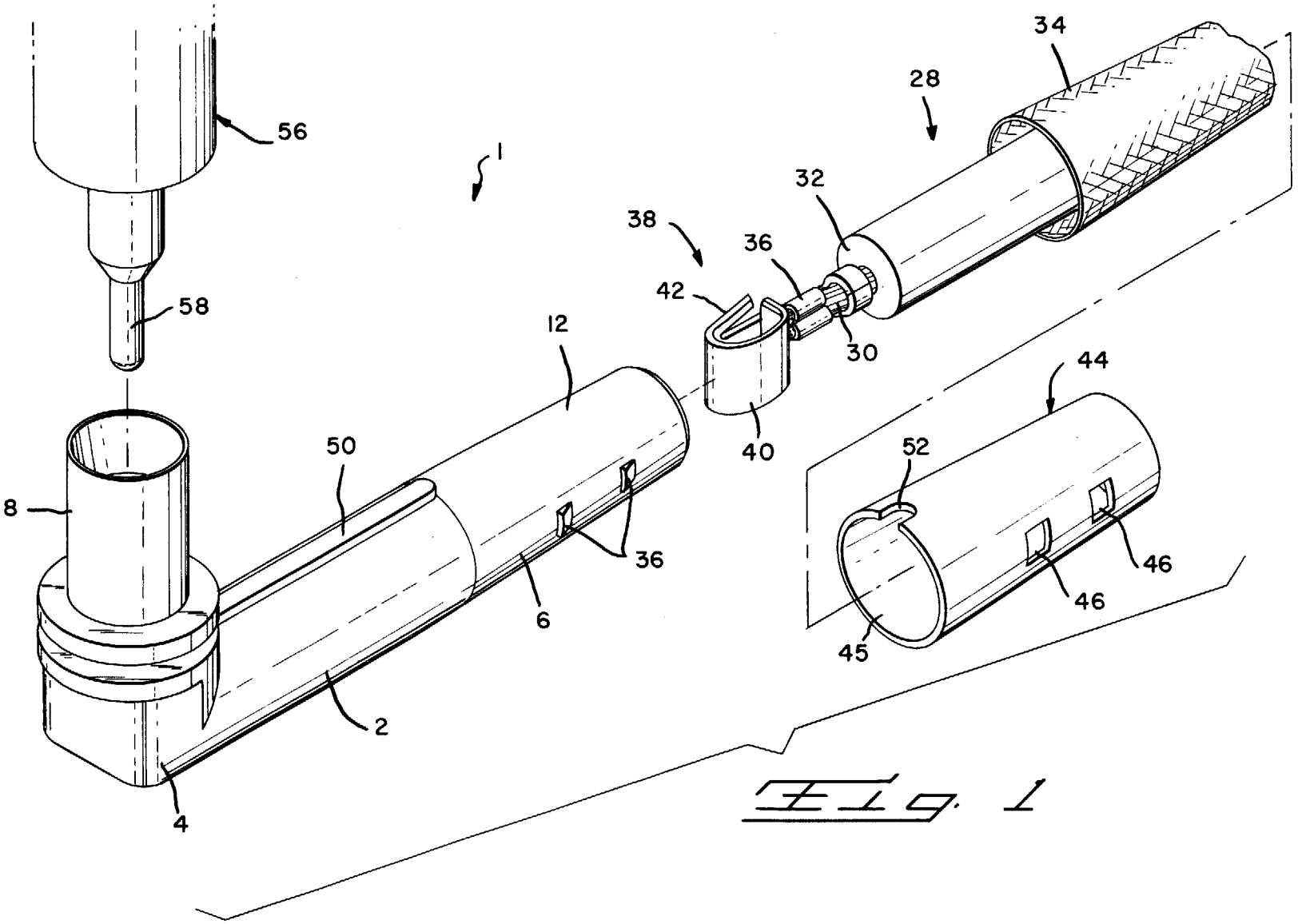
FIG. 1 is an enlarged fragmentary perspective with parts in exploded configuration illustrating a preferred embodiment of a connector according to the present invention.

With more particular reference to the drawings there is shown generally at 1 in FIG. 1 an electrical connector according to the present invention. The connector includes a dielectric body portion 2 having an elbow section 4 and outwardly diverging end sections 6 and 8 which diverge at right angles from the elbow section 4. The portion 6 is more particularly shown in FIGS. 1 and 2 as being of relatively elongated cylindrical configuration having an internal cylindrical recess 10 through an end 12. The recess 10 includes a reduced stepped portion 14 terminating in a curved bottom wall portion 16.

Figure 3:
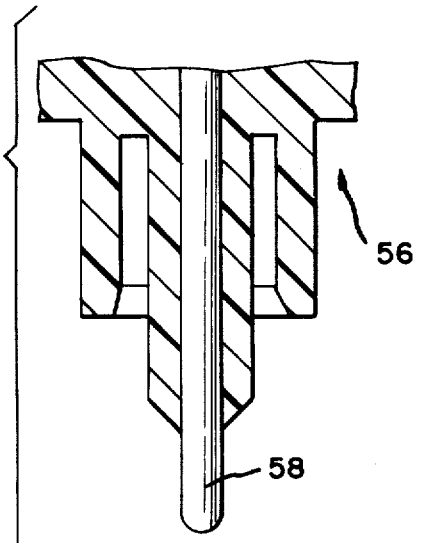
FIG. 3 is an exploded fragmentary enlarged elevation in section of a portion of the connector shown in FIG. 1.
Figure 4:
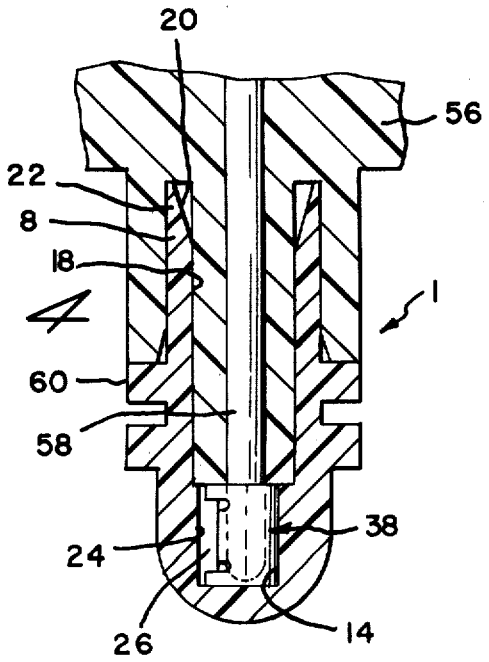
FIG. 4 is an enlarged fragmentary elevation taken along the line 4—4 of FIG. 2.
Figure 4:
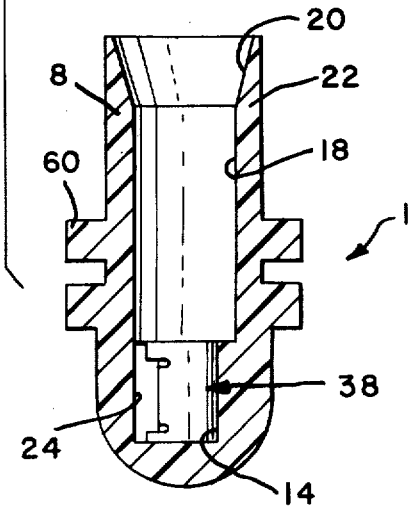

The end 8 of the connector 1, shown more particularly in FIGS. 1, 3 and 4, also is generally cylindrical and includes a generally cylindrical recess 18 communicating with an outwardly flared counterbore 20 provided in terminal end 22 of the portion 8. The cylindrical excess 18 is provided with a reduced stepped recess 24 having a sidewall which is continuous with the cylindrical sidewall 18 and which intercepts the reduced stepped portion 14 of the recess 10 adjacent the bottom wall 16. The recess portion 24 provides a shoulder 26 for purpose to be described.

Figure 2:
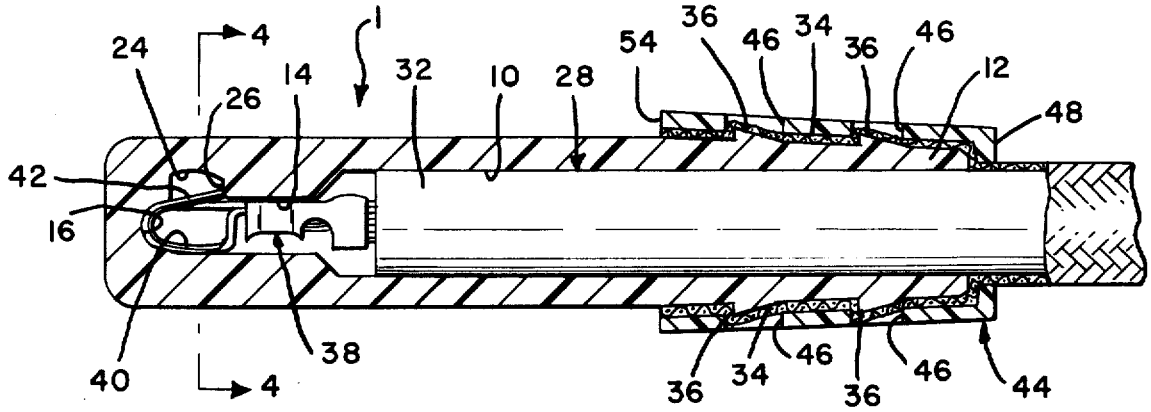
FIG. 2 is a plan view in section of the assembled connector of FIG. 1.

As shown more particularly in FIGS. 1 and 2 a high voltage electrical lead generally shown at 28 includes a central multistrand conductor 38 within a sheath of dielectric 32 such as Teflon or silicone. The lead 28 further includes a conductive shield or sheath 34 over the insulation 32. As shown the sheath 34 is of braided metal although other conductive sheath types may be provided. The conductor 30 is suitably exposed by stripping away a portion of the sheath 34 and a portion of the insulation 32. The exposed conductor 30 is then terminated such as by crimping or cold forging to a wire barrel portion 36 of a receptacle type of electrical contact shown generally at 38. The contact 38 includes a resilient enclosed loop portion 40 with at least one integral resilient projecting tine 42.

The terminated lead 28 is readily inserted within the aperture 10. The contact 38 is readily inserted within the stepped portion 14 of the recess 10 until the loop portion 40 of the contact seats against the bottom wall 16. The tine 42 then resiliently deflects outwardly of the loop portion 40 because of its inherent stored spring energy such that it enters the recess portion 24. The tine will engage and latch against the shoulder portion 26 preventing removal of the terminated lead from the connector 1 anchoring the terminal 38 and the terminated lead in the connector.

As shown in FIG. 2 the conductive sheath 34 is received over the end 12 of the connector. The end 12 is more particularly shown as being externally tapered and provided with a plurality of outwardly projecting teeth 36. A suitable tapered sleeve 38 of thin dielectric or resilient thin metal is slidably receiver over the end 12. The sleeve is provided with a plurality of apertures 40 which latchably receive corresponding teeth 36 therein. In this manner the braid 34 is captivated by the sleeve and is sandwiched between the sleeve and the end 12 of the connector. The thin sleeve may be readily removed by forcible deformation thereof when it is desired to disassemble the connector from the high voltage lead. Also a suitable tool may be inserted through the recess portions 18 and 24 in order to deflect the tine 42 inwardly into the looped portion 40 and unlatch the contact and permit withdrawal of the terminated lead 20 from the connector. The sleeve is provided at one end with an inwardly projecting flange portion 48 which engages against the end portion 12, with the braid 34 sandwiched therebetween, limiting receipt of the sleeve and correctly positioning the same over the end portion 12. Also suitably to position the sleeve, the connector is shown in FIG. 1 as having an integral projecting rib or ridge portion 50 terminating adjacent to the tapered end portion 12. The sleeve is provided with a recess or notch portion 52 at one end 54 thereof which receives the end of the rib or ridge 50 when the sleeve is suitably latched to the teeth 36. The rib 50 and notch 52 thus provided a polarization feature properly orienting the sleeve for latchable receipt of the teeth 36 together with unbroken portions of the braid within corresponding apertures 46. The braid is thereby anchored to the connector.

As shown more particularly in FIGS. 1 and 4 a portion of a high voltage electrical tube is shown generally at 56. The tube forms no part of the present invention and is of well known design. The tube does include a projecting male electrical terminal or post portion 58 which is readily pluggably received into the portion 8 of the connector which forms a socket connection for the tube 56. The post 58 is pluggably received within the looped portion 40 of a receptacle type contact 38 providing an electrical connection between the tube and the high voltage electrical lead 28. The tube is readily unplugged from the connector 1 especially for purpose of replacement thereof without dangerously exposing the high voltage lead 28 or the contact 38. The contact 38 is deeply recessed within the recess portion 18 and 14 preventing electrical shock and allowing the lead to remain energized at all times without danger of shock or electrical shorting to adjacent equipment. As an additional feature, the end portion 8 is provided with at least one outwardly projecting integral flange portion 60 against which the tube 56 is seated as an indication to an operator that the tube is suitably and fully connected to the connector 1.

Although a preferred embodiment of the present invention has been illustrated and described in detail other embodiments and modifications of the present invention which would be apparent to one having ordinary skill in the art are intended to be covered by the spirit and scope of the appended claims.

What is claimed is:

1. A right angle connector for a high voltage electrical tube and a high voltage lead, comprising:

an elbow shaped dielectric shell having one end portion provided with outwardly projecting teeth, a conductive sheath of an electrical lead received over said one end portion of said shell and covering said outwardly projecting teeth, a complimentary sleeve slidably received over said one end portion of said shell and captivating therebetween said conductive sheath, said sleeve being provided with apertures disposed over said sheath and latchably receiving therein corresponding sheath covered teeth, polarizing means in one end of said sleeve orienting said sleeve onto said one end portion of said shell, a first recess in said one end portion of said shell for receiving said electrical lead therein together with an electrical contact terminated to said lead, said first recess ending in a contact seating portion, said contact seating in said contact seating portion and preventing removal of said terminated lead, and the other end portion of said shell being at a right angle with said one end portion and provided with a second recess communicating with said contact seating portion of said first recess for pluggably receiving a plug end of a high voltage electrical tube in electrically connected relationship with said contact.

2. The structure as recited in claim 1, and further including:

an integral outwardly projecting flange portion on said other end portion of said shell providing a seat for pluggable receipt thereagainst of a high voltage electrical tube pluggably received in said connector.

3. The structure as recited in claim 1, wherein, said contact includes a tine portion, and further including:

a shoulder defined by said shell in said first recess, a recess portion adjacent said shoulder communicating with said other end portion of said shell whereby a retraction tool may be inserted in said recess portion through said other end portion of said shell to disengage said tine from engagement with said shoulder and permit removal of said terminated lead from said connector.

* * * * *